US008505610B2

(12) United States Patent
Svensson et al.

(10) Patent No.: US 8,505,610 B2
(45) Date of Patent: Aug. 13, 2013

(54) MOULD AND A METHOD OF ITS MANUFACTURE

(75) Inventors: Christer Svensson, Karlshamn (SE); Tomas Nilsson, Katrineholm (SE); Rudolf Sillen, Kellinge (SE)

(73) Assignee: Verktygs Allians i Hässleholm AB, Hässleholm (SE)

( * ) Notice: Subject to any disclaimer, the term of this patent is extended or adjusted under 35 U.S.C. 154(b) by 50 days.

(21) Appl. No.: 12/920,897

(22) PCT Filed: Mar. 5, 2009

(86) PCT No.: PCT/SE2009/000125
§ 371 (c)(1),
(2), (4) Date: Nov. 15, 2010

(87) PCT Pub. No.: WO2009/110833
PCT Pub. Date: Sep. 11, 2009

(65) Prior Publication Data

US 2011/0120664 A1 May 26, 2011

(30) Foreign Application Priority Data

Mar. 6, 2008 (SE) ..... 0800523

(51) Int. Cl.
*B22C 9/00* (2006.01)
*B22C 9/22* (2006.01)

(52) U.S. Cl.
USPC ..... 164/6; 164/271

(58) Field of Classification Search
USPC ..... 164/6, 34, 45, 91, 94, 95, 98, 271
See application file for complete search history.

(56) References Cited

FOREIGN PATENT DOCUMENTS

DE 19816838 A1 11/1999
WO 03041895 A1 5/2003

OTHER PUBLICATIONS

International Search Report for corresponding International App. PCT/SE2009/000125, mailed Jul. 2, 2009.
JP3189065 A, Takagi Chuko KK, Aug. 19, 1991 (abstract).
JP2004255424 A, Asai Takashi, Sep. 16, 2004 (abstract).
JP 63002549 A, Hitachi Metals Ltd., Jan. 7, 1988 (abstract).
JP 1027763 A, Akebono Brake Res. & Dev. Center Ltd., Jan. 30, 1989.
JP 63036967 A, Tousei Kogyo KK, Feb. 17, 1988 (abstract).
JP 63231014 A, Mitsubishi Heavy Ind. Ltd., Sep. 27, 1988.

*Primary Examiner* — Kevin P Kerns
(74) *Attorney, Agent, or Firm* — WRB-IP LLP

(57) ABSTRACT

A mold for casting in one piece of a tool with a working component of steel and a body of grey iron with an interconnection zone there between has a first model section corresponding to the working component and a second model section corresponding to the body. The model sections are in contact with one another along a contact plane which is horizontal and planar and which represents the interconnection zone. In a method for producing a mold for one piece casting of a tool with a working component of steel and a body of grey iron with an interconnection zone therebetween; a first model section is produced corresponding to the steel and a second model section corresponding to the grey iron. The model sections are brought into contact with one another with the contact surface horizontally aligned and with the first model section lowermost.

9 Claims, 3 Drawing Sheets

MOULD AND A METHOD OF ITS MANUFACTURE

BACKGROUND AND SUMMARY

The present invention relates to a mould for composite casting of a one-piece cast tool, which comprises at least a first portion, comprising the working component of the tool and which is manufactured from steel, and a second portion, which comprises the body component of the tool and which is manufactured from grey iron, there being at least one interconnection zone between the steel and the grey iron.

The present invention also relates to a method of manufacturing a mould for composite casting of a one-piece cast tool, which comprises at least a first portion comprising the working component of the tool and which is manufactured from steel and a second portion comprising the body component of the tool and which is manufactured from grey iron, there being at least one interconnection zone between the steel and the grey iron.

In the manufacture of tools for sheet metal working such as cutting, bending or other shaping, it has previously often been the practice to separately produce a tool body of grey iron. This tool body has previously been provided with working components, which carry out the actual operations for which the tool is intended. The manufacture of the tool body takes place by casting, and after the casting, heat treatment of the tool body is often required. This is followed by machining of the tool body in order to realise the requisite seats for the working component or components of the tool, guide stub shafts and bolt holes for fixing them but also to make possible fixing of the tool body in a machine.

In the production of the working component or components which the tool is to have, the point of departure has often been bar material, the working components being machined to the correct shape, provided with apertures for fixing bolts, guide stub shafts and the like. This has normally been followed by heat treatment, whereafter additional machining, for example grinding, is carried out.

Producing a tool in the above-outlined method is extremely time consuming and expensive and is, therefore, often determinative of the time consumption which is required for the new production of different products.

WO 03/041895 discloses a one-piece composite cast tool and a method of its manufacture, where the tool has different material compositions in different parts of the tool. Manufacture according to this publication has, however, encountered major problems in certain respects, for example the formation of a mould model which is to be employed.

It is desirable to design the mould intimated by way of introduction so that it obviates the drawbacks inherent in the prior art technology. In particular, it is desirable to design a mould so that it may be produced at low cost and with high precision. Further, it is desirable to design the mould so that it is possible, without difficulty, to cast material with different coefficients of thermal expansion in one and the same mould.

According to an aspect of the present invention, a mould is characterised in that it comprises at least a first model section corresponding to the first portion and at least a second model section corresponding to the second portion, the first model section being in contact with the second model section along at least one contact plane which is horizontal and planar in the position of use of the mould and which, in the mould, represents the interconnection zone.

According to another aspect of the present invention, a method is characterised in that a first model section is produced corresponding to the first portion, that a second model section is produced corresponding to the second portion, that the sections are given at least one planar contact surface along which they are brought into contact with one another, that the mould is finished with a mould material, the contact surface being aligned to a horizontal position intended for the interconnection zone in the moulding position of the mould and the first model section is positioned lowermost.

BRIEF DESCRIPTION OF THE ACCOMPANYING DRAWINGS

The present invention will now be described in greater detail hereinbelow, with reference to the accompanying Drawings. In the accompanying Drawings.

DETAILED DESCRIPTION

Figure 1:
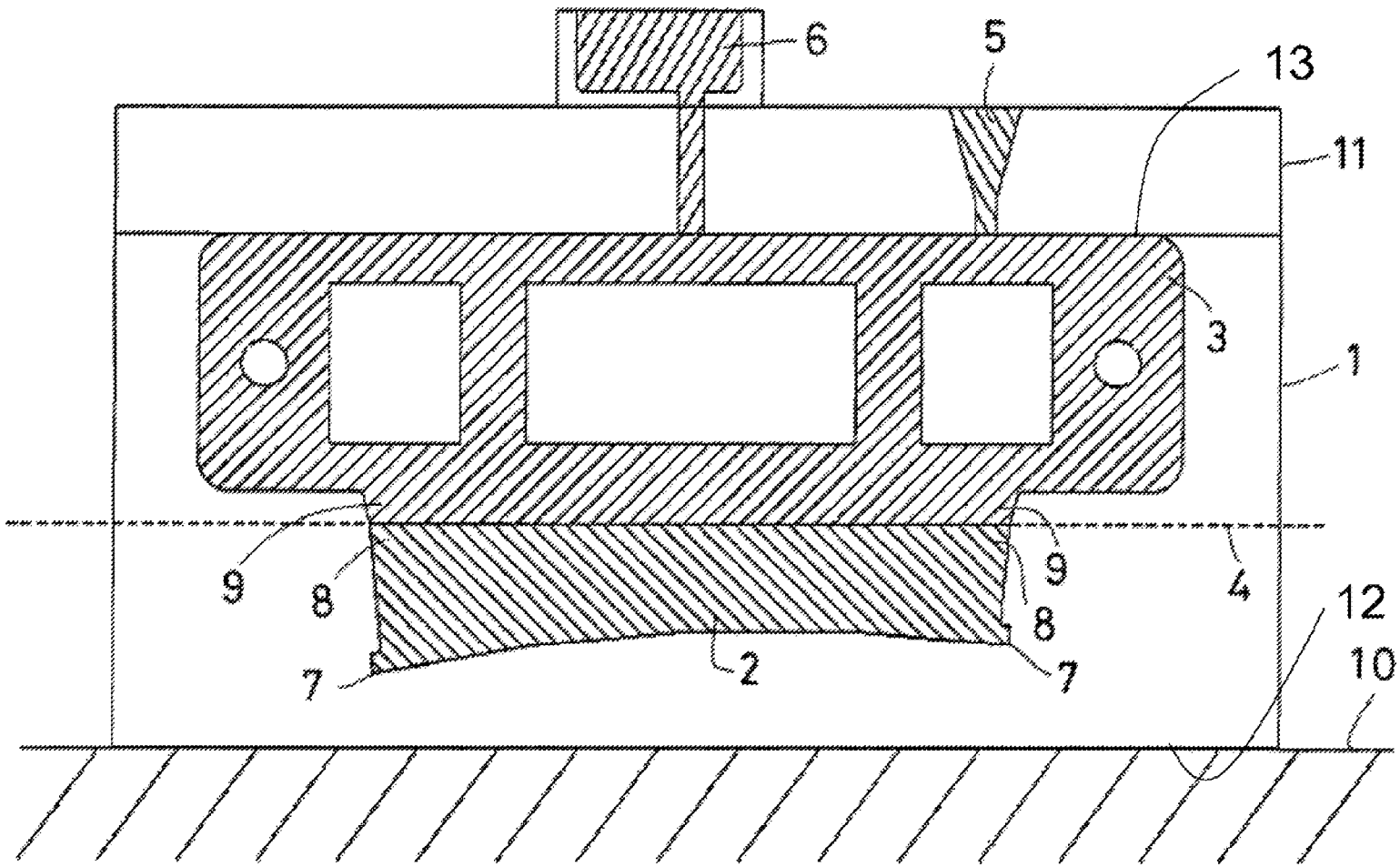
FIG. 1 is a simplified cross section through a mould according to the present invention.

In FIG. 1, which shows a section through a mould according to the invention, reference numeral 1 relates to a moulding box or flask, reference numeral 2 to a first section of a mould model and reference numeral 3 to a second section of the mould model. Both of the sections of the mould model are produced of a material which is destructible in the casting operation, for example expanded polystyrene.

According to the present invention, it may in certain alternative special cases, be possible to manufacture the mould model or part thereof also in a non-destructible material on casting. Such a mould model must then be removed from mould before casting can take place. It may also in certain cases be advantageous, in alternative embodiments, also to remove a destructible model on the casting, or a part thereof before the casting is carried out, for example if mould cores are employed.

The first section 2 of the mould model is intended for casting of steel, while the second section 3 of the mould model is intended for casting of grey iron, so that there is formed between these two materials, an interconnection zone at a contact plane 4 which is represented by a broken line in the Figure. Such an interconnection zone may, if the present invention is reduced into practice correctly, have a thickness of 1 to 2.5 mm, where both of the casting materials are more or less mixed.

For casting of the steel, there is an ingate or sprue 5, which is connected to an ingate system which at least partly is located beneath the first model section 2 and which is designed for casting in a direction from beneath and upwards in the position of use of the mould, which is shown in FIG. 1. In this position of use, the contact plane 4 is horizontal.

It should be emphasised that, even though FIG. 1 only shows a single first section 2 of the model, there may, in one and the same moulding box or flask 1, be located a plurality of such first sections which are intended to form working components in the tool which is cast in the mould. The working components may be designed for cutting, hole making, bending or other shaping of sheet metal. In FIG. 1, for example cutting edges are illustrated at reference numeral 7.

The first section 2 of the mould has, in its end facing towards the contact plane 4, a wall portion 8 which is of substantially uniform thickness throughout its entire extent. Correspondingly, the second section 3 of the model has, in the region of the contact plane 4, a wall portion 9 which, in terms of shape and thickness, corresponds to the wall portion 8, but with certain differences, as will be described in detail hereinbelow.

In FIG. 1, the contact plane 4 is parallel with the lower edge 10 of the moulding box 1, which guarantees that the contact plane 4 will be horizontal if the moulding box is placed on a planar and horizontal substrate, for example a floor.

In the production of the mould according to FIG. 1, an upper portion 11 to the moulding box is first removed, and the moulding box 1 is placed on a planar, horizontal substrate with its upper edge 12 turned to face downwards. Thereafter, the total model, which thus consists of or comprises one or more first sections 2 and one second section 3 is placed on a substrate on which the upper edge 12 of the moulding box 1 rests. However, this presupposes that the contact plane 4 is parallel with the upper surface 13 of the second model section 3. What is important is that the contact plane 4 comes to be horizontal in the casting position of the mould, in the mould illustrated in FIG. 1, parallel with the lower edge 10 of the moulding box.

It may be appropriate to join together the second model section 3 with the first model section or sections 2, so that they together form a manageable unit.

Thereafter, the moulding box or flask 1 is filled with moulding or foundry sand of suitable quality, and it should be emphasised that this moulding sand need not have the same quality around the second model section 3 and the first model section or sections 2. When, by such means, the moulding box 1 has been filled with moulding sand and this has been tamped down and allowed to set, the moulding box 1 is turned to the moulding position, it being ensured that the contact plane 4 is horizontal in that the substrate on which the moulding box is placed is also horizontal. Thereafter, the upper portion 11 is placed on the moulding box 1 and the mould is completed with the ingates 5 and 6.

If the second section 3 of the model does not have its upper side 13 (according to FIG. 1) parallel with the contact plane 4, the second model section 3 must be chocked up to a correct inclination which compensates for the non-parallelism between the contact plane 4 and the upper surface 13, so that as a result, in the finished mould, the contact plane 4 will always be horizontal when the moulding box 1 rests on a horizontal substrate.

Figure 2:
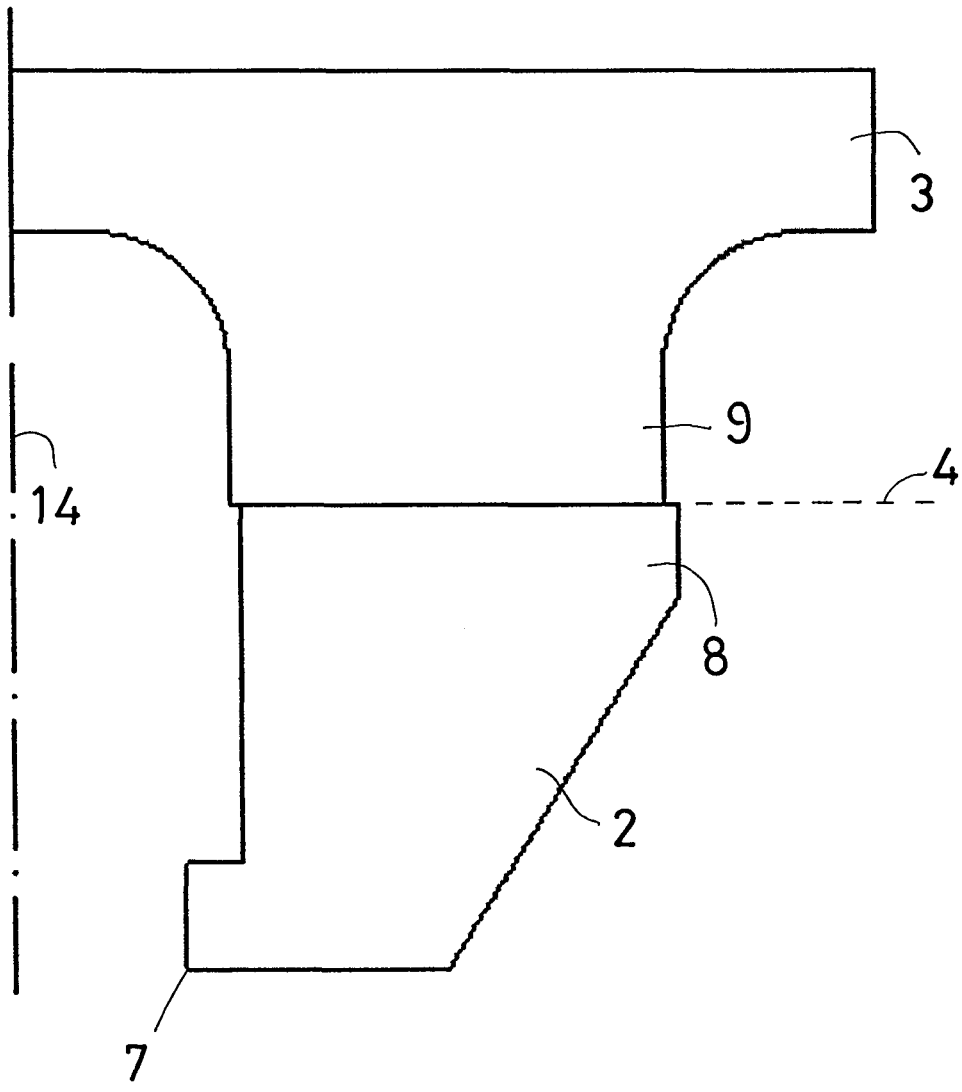
FIG. 2 is a detailed cross section through a part of a mould model for producing the mould according to the present invention.

In composite casting of two different casting materials, these often have different coefficients of thermal expansion, which could create problems at the interconnection zone at the contact plane 4 between both sections 2 and 3 of the mould model. In the pertinent example here, the steel is cast first in the first section 2 of the mould model and is allowed partly to cool before the casting of the grey iron takes place in the second section 3 of the model. Of the two materials, the steel displays a considerably greater coefficient of thermal expansion than applies to the grey iron. For this reason, the first section or sections 2 of the model are designed with a greater shrinkage margin than applies to the second section 3 of the model. This relationship is illustrated in FIG. 2 which shows parts of the first section 2 of the model and its second section 3 with both of the walls 8 and 9 on both sides of the contact plane 4. It is presupposed that the mould model extends to the left of the ghosted line 14.

It will be apparent from the Drawing that the wall portion 8 is not in line with the wall portion 9, but is displaced in a direction to the right in the Figure, since the cast steel is expected to shrink in a direction to the left.

Figure 3:
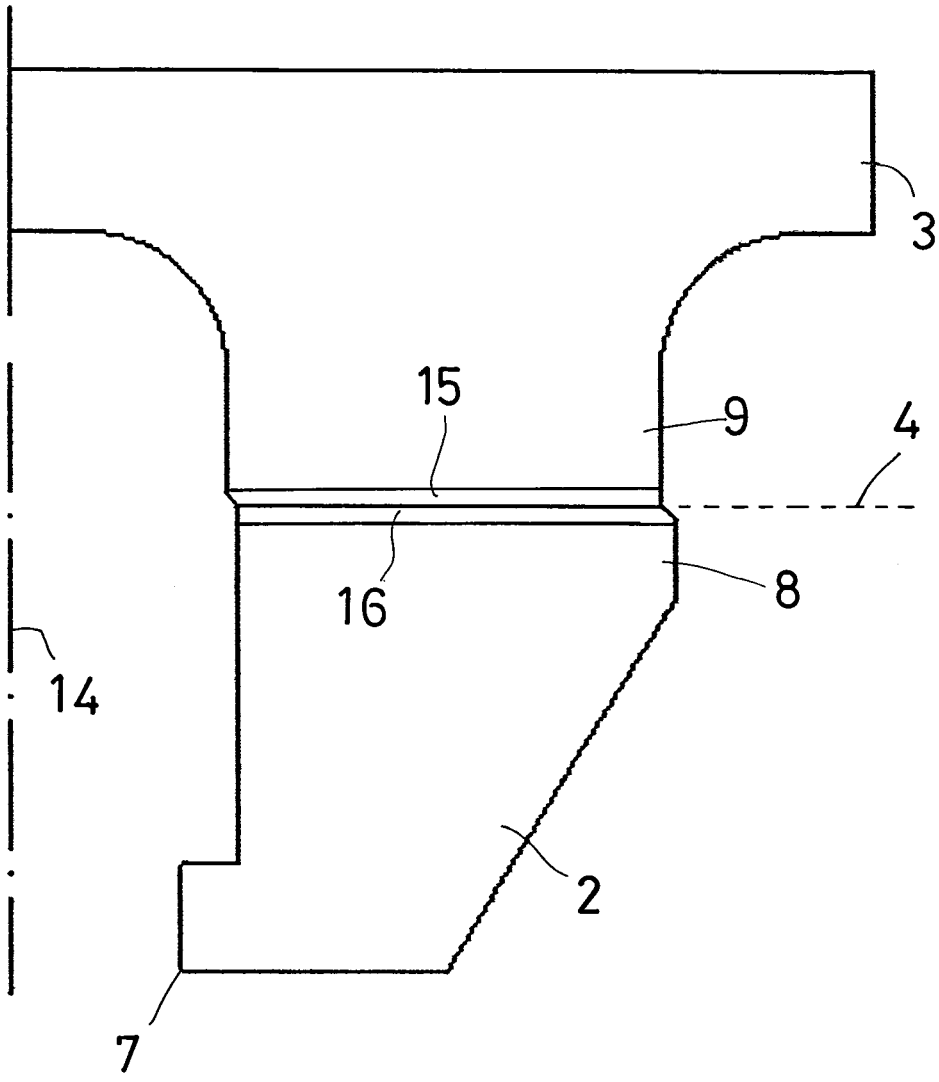
FIG. 3 shows the mould model according to FIG. 2 in the finished state.

It will be apparent from FIG. 3 that the model sections 2 and 3 are chamfered, with a bevel 15 along the wall portion 9 and a bevel 16 along the wall portion 8. By such means, the transitional region between the wall portions 8 and 9, i.e. the interconnection zone located at the contact plane 4 between the steel and the grey iron will be smoother in the transition.

In order to hold together the two model sections 2 and 3, these can be glued together or the joint can be held together by tape or the like.

In the above described embodiment, both of the model sections 2 and 3 lie in one and the same moulding box 1.

In one alternative version, the moulding box 1 may be divided into a lower moulding box which only accommodates the first section or sections 2 of the model, while an upper moulding box is used for the second section 3 of the model.

When a thus divided moulding box is used, the first section 2 of the model is placed on a planar substrate interiorly in the lower moulding box, whereafter moulding sand is added and packed and set. Thereafter, the lower moulding box is inverted and the upper moulding box is placed upon it. Thereafter, the second section 3 of the model is placed in the correct position above the lower moulding box and the contact plane 4, whereafter the mould is finished.

In the alternative embodiment, it is also possible on casting to place mould cores beneath the contact plane 4 which, on the casting of the steel, provide cavities therein. After opening of the mould, i.e. removal of the upper moulding box, the cores may be removed and the cast steel be inspected before the upper moulding box is once again mounted and clamped and casting of the grey iron takes place.

What is claimed is:

1. A mold for composite casting of a one-piece cast tool, which comprises at least a first portion defining a working component of the tool and which is manufactured from steel, and a second portion which defines a body component of the tool and which is manufactured from grey iron, there being at least one interconnection zone between the steel and the grey iron, the mold comprising:

more than one first model section corresponding to the first portion, and a second model section corresponding to the second portion, the more than one first model section being in contact with the second model section along more than one contact surface which is horizontal and planar in a position of use of the mold and which, in the mold, represents the interconnection zone wherein all contact surfaces lie in a common plane.

2. The mold as claimed in claim 1, wherein the more than one first mold section is designed for a greater shrinkage margin than the second model section.

3. The mold as claimed in claim 1, wherein model sections mutually meeting at the contact plane have bevelled transitional regions for avoiding stepped transitions at the contact plane.

4. The mold as claimed in claim 1, wherein the more than one first mold section is interconnected to an adjacent portion of the second mold section.

5. A method of producing a mold for composite casting of a one piece cast tool, which includes at least a first portion which defines a working component of the tool and which is manufactured from steel, and a second portion which defines a body component of the tool and which is manufactured from grey iron, there being at least one interconnection zone between the steel and the grey iron, comprising producing more than one first model section in correspondence with the first portion, producing a second model section in correspondence to the second portion, providing each of the more than one first model section and second model section with more than one planar contact surface along which they are brought into contact with one another, finishing the mold with a molding material, positioning the mold in a casting position in which the more than one contact surface is in a horizontal position, the more than one contact surface representing, in the mold, the interconnection zone, and in which the more than one first model section is positioned below the second model section, wherein all contact surfaces lie in a common plane.

6. The method as claimed in claim 5, wherein the more than one first model section is designed for greater shrinkage margin than the second model section.

7. The method as claimed in claim 5, wherein the more than one first model section is interconnected with the second model section before the mold is finished.

8. The method as claimed in claim 5, wherein more than one first model section and the second model section mutually meeting at the contact plane are bevelled in transitional regions for avoiding stepped transitions at the contact plane.

9. The method as claimed in claim 5, wherein the first mold sections are interconnected to adjacent portions of the second mold section.

* * * * *